US009429910B1

(12) United States Patent
Watts et al.

(10) Patent No.: US 9,429,910 B1
(45) Date of Patent: Aug. 30, 2016

(54) FAN BYPASS SYSTEM FOR CONTAMINATION CONTROL

(71) Applicant: XEROX CORPORATION, Norwalk, CT (US)

(72) Inventors: Christopher F. D. Watts, Hertfordshire (GB); Jean H. Smith, Loughborough (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/656,195

(22) Filed: Mar. 12, 2015

(51) Int. Cl.
*G03G 21/20* (2006.01)
*G03G 21/00* (2006.01)

(52) U.S. Cl.
CPC ..... *G03G 21/206* (2013.01); *G03G 21/0052* (2013.01); *G03G 2221/1645* (2013.01)

(58) Field of Classification Search
CPC ..... G03G 21/0052; G03G 21/206; G03G 2221/1645
USPC ..... 399/92, 93, 98, 355
See application file for complete search history.

(56) References Cited

U.S. PATENT DOCUMENTS 6,293,294 B1 * 9/2001 Loeb ..... B01F 5/0405 137/1
6,754,457 B2 * 6/2004 Ciaschi et al. ..... 399/92
8,139,995 B1 * 3/2012 Fujita et al. ..... 399/390
8,346,116 B2 * 1/2013 Tsuda et al. ..... 399/92
2005/0180772 A1 * 8/2005 Dergham et al. ..... 399/92

FOREIGN PATENT DOCUMENTS

WO WO 2015031429 A1 * 3/2015

* cited by examiner

*Primary Examiner* — David Gray
*Assistant Examiner* — Trevor J Bervik
(74) *Attorney, Agent, or Firm* — Ronald E. Prass, Jr.; Prass LLP

(57) ABSTRACT

A contamination control apparatus for controlling contamination in an image forming device is provided. The apparatus includes an air mover located in the image forming device; a first duct, a first end of the first duct receiving non-contaminated air, and a second end of the first duct being fluidly connected to an air input of the air mover such that the air input receives the non-contaminated air from the first duct; an exhaust duct, a first end of the exhaust duct being fluidly connected to an air output of the air mover such that the exhaust duct receives the non-contaminated air from the air output; and a second duct, a first end of the second duct being positioned such that contaminated air is drawn into the second duct, and a second end of the second duct being fluidly connected to the exhaust duct at a position downstream of the air output of the air mover and upstream of the second end of the exhaust duct.

19 Claims, 4 Drawing Sheets

RELATED ART

FAN BYPASS SYSTEM FOR CONTAMINATION CONTROL

BACKGROUND

Disclosed herein are systems and methods for reducing the toner dirt contamination in an image forming device.

Embodiments of the disclosure are well suited for image forming devices having a blower that removes air from an internal space of the image forming device.

SUMMARY

Some image forming devices use a blower to control contamination, for example dust and/or toner collection, in the image forming device. The blower creates a negative pressure region and sucks up the contaminants. These systems, however, result in the contaminated air moving through the blower from the negative pressure side to the positive pressure side. This leads to degradation in flow performance, noise, bearing wear and possible component failure and replacement cost.

Embodiments of the disclosure provide an improved way to control contamination in an image forming device by preventing the contaminated air from passing through the blower.

An embodiment of the disclosure may include a contamination control apparatus for controlling contamination in an image forming device. The apparatus includes an air mover located in the image forming device, the air mover having an air input and an air output; a first duct having a first end and a second end, the first end having an opening positioned to receive non-contaminated air that is not contaminated with the contamination from inside the image forming device, and the second end being fluidly connected to the air input of the air mover such that the air input receives the non-contaminated air from the first duct; an exhaust duct having a first end and a second end, the first end being fluidly connected to the air output of the air mover such that the exhaust duct receives the non-contaminated air from the air output; and a second duct having a first end and a second end, the first end being positioned such that contaminated air from a contamination producing element of the image forming device is drawn into the first end of the second duct, and the second end of the second duct being fluidly connected to the exhaust duct at a position downstream of the air output of the air mover and upstream of the second end of the exhaust duct. The non-contaminated air and the contaminated air are mixed together in the exhaust duct downstream of the air output of the air mover and upstream of the second end of the exhaust duct to form a mixed air, and the mixed air is exhausted from the second end of the exhaust duct.

Another embodiment of the disclosure may include an image forming device. The image forming device includes an image forming section that produces contamination; a contamination control apparatus for controlling the contamination, the contamination control apparatus having an air mover located in the image forming device, the air mover having an air input and an air output; a first duct having a first end and a second end, the first end having an opening positioned to receive non-contaminated air that is not contaminated with the contamination, and the second end being fluidly connected to the air input of the air mover such that the air input receives the non-contaminated air from the first duct; an exhaust duct having a first end and a second end, the first end being fluidly connected to the air output of the air mover such that the exhaust duct receives the non-contaminated air from the air output; and a second duct having a first end and a second end, the first end being positioned such that contaminated air from the image forming section of the image forming device is drawn into the first end of the second duct, and the second end of the second duct being fluidly connected to the exhaust duct at a position downstream of the air output of the air mover and upstream of the second end of the exhaust duct. The non-contaminated air and the contaminated air are mixed together in the exhaust duct downstream of the air output of the air mover and upstream of the second end of the exhaust duct to form a mixed air, and the mixed air is exhausted from the second end of the exhaust duct.

Another embodiment of the disclosure may include a method of controlling contamination in an image forming device. The method includes moving with an air mover non-contaminated air that is not contaminated with the contamination from inside the image forming device; moving the non-contaminated air through a first duct having a first end and a second end, the first end having an opening positioned to receive the non-contaminated air, and the second end being fluidly connected to an air input of the air mover such that the air input receives the non-contaminated air from the first duct; moving the non-contaminated air through an exhaust duct having a first end and a second end, the first end being fluidly connected to an air output of the air mover such that the exhaust duct receives the non-contaminated air from the air output; and moving contaminated air from a contamination producing element of the image forming device though a second duct having a first end and a second end, the first end being positioned such that the contaminated air is drawn into the first end of the second duct, and the second end of the second duct being fluidly connected to the exhaust duct at a position downstream of the air output of the air mover and upstream of the second end of the exhaust duct. The non-contaminated air and the contaminated air are mixed together in the exhaust duct downstream of the air output of the air mover and upstream of the second end of the exhaust duct to form a mixed air, the mixed air is exhausted from the second end of the exhaust duct, and a flow of the non-contaminated air in the exhaust duct creates a negative pressure in the second duct, the negative pressure causing the contaminated air to flow through the second duct.

DETAILED DESCRIPTION

The disclosed embodiments may include a contamination control apparatus for controlling contamination in an image forming device. The apparatus includes an air mover located in the image forming device, the air mover having an air input and an air output; a first duct having a first end and a second end, the first end having an opening positioned to receive non-contaminated air that is not contaminated with the contamination from inside the image forming device, and the second end being fluidly connected to the air input of the air mover such that the air input receives the non-contaminated air from the first duct; an exhaust duct having a first end and a second end, the first end being fluidly connected to the air output of the air mover such that the exhaust duct receives the non-contaminated air from the air output; and a second duct having a first end and a second end, the first end being positioned such that contaminated air from a contamination producing element of the image forming device is drawn into the first end of the second duct, and the second end of the second duct being fluidly connected to the exhaust duct at a position downstream of the air output of the air mover and upstream of the second end of the exhaust duct. The non-contaminated air and the contaminated air are mixed together in the exhaust duct downstream of the air output of the air mover and upstream of the second end of the exhaust duct to form a mixed air, and the mixed air is exhausted from the second end of the exhaust duct.

Some embodiments also provide a flow of the non-contaminated air in the exhaust duct creating a negative pressure in the second duct, the negative pressure causing the contaminated air to flow through the second duct.

Figure 1:
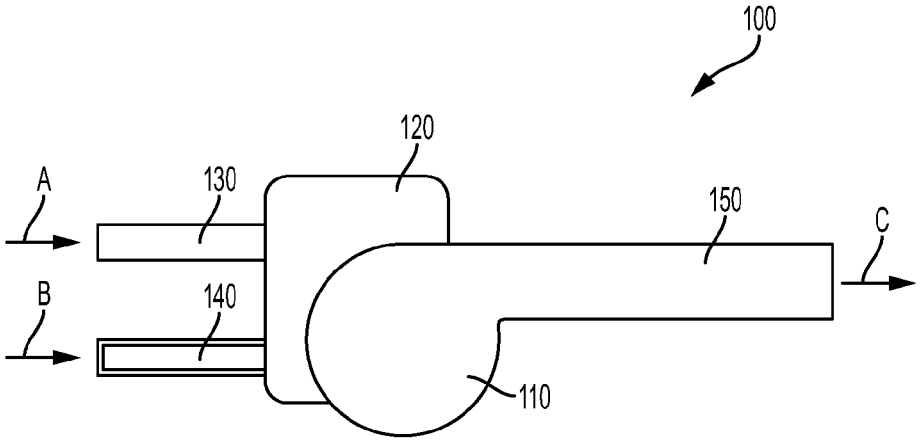
FIG. 1 is a schematic view of a blower unit for use in an image forming apparatus.

FIG. 1 shows a blower system 100 for moving air in an image forming device. Blower system 100 uses a blower 110 to move air from arrows A and B to arrow C. In this example, clean air is pulled through a clean air duct 130 and a plenum 120 by blower 110. Contaminated air is pulled through a contaminated air duct 140 and plenum 120 by blower 110. The clean air and the contaminated air mix in plenum 120. The combined clean/contaminated air is then pushed out of an outlet duct 150 by blower 110. A problem with the configuration shown in FIG. 1 is that the contaminants in the contaminated air pass through blower 110. These contaminants can, over time, cause damage to blower 110, resulting in degradation of performance and possibly failure of blower 110.

Figure 2:
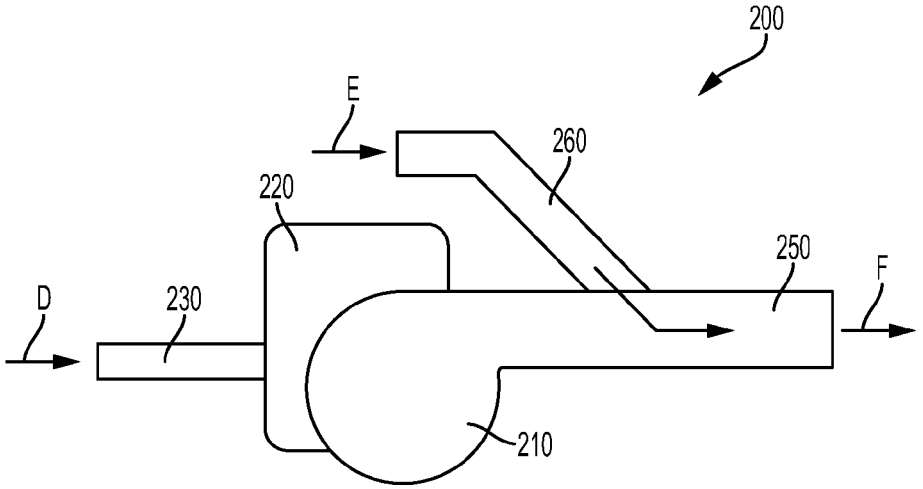
FIG. 2 is a schematic use of an example of a contamination control apparatus in accordance with embodiments of the disclosure.

FIG. 2 shows an example of a contamination control apparatus 200 for use in an image forming device. Contamination control apparatus 200 includes a blower 210 that moves air from arrows D and E to arrow F. In this example, clean air (arrow D) is pulled through a first duct 230 and a plenum 220 by blower 210. The clean air is then pushed out of exhaust duct 250 by blower 210. An outlet end of a second duct 260 intersects exhaust duct 250 at a position downstream of blower 210. The passage of clean air through exhaust duct 250 creates a negative pressure region in second duct 260. This negative pressure region results in air (arrow E) being pulled through second duct 260, through exhaust duct 250 and out of en exit end of exhaust duct 250 (arrow F). The air pulled through second duct 260 can contain contaminants without subjecting blower 210 to those contaminants because the air pulled through second duct 260 does not pass through blower 210.

Figure 3:
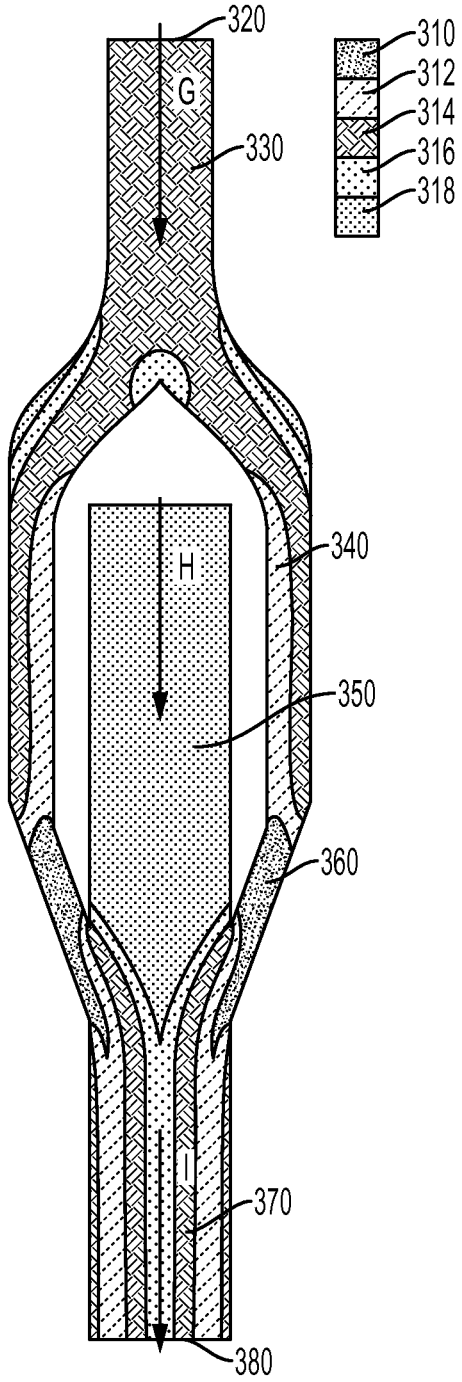
FIG. 3 shows flow velocities in an experimental device.

FIG. 3 shows the results of computational fluid dynamics analysis used to model and demonstrate the capability of embodiments of the disclosure. FIG. 3 shows clean air (arrow G) entering duct 330 at opening 320, being split into ducts 340/360, and then re-combining in duct 370. As a result of the accelerated flow pushing back into duct 370, air (arrow H) is pulled into duct 350. The combination of air pulled in through duct 330 (arrow G) and duct 350 (arrow H) is exhausted out of outlet 380 (arrow I). The flow velocity through the apparatus of FIG. 3 is represented by the shadings 310, 312, 314, 316, 318. Shading 310 represents the lowest flow velocity and shading 318 represents the highest flow velocity, with shadings 312, 314, 316 representing increasing intermediate flow velocities.

As can be seen from FIG. 3, ducts 360 are smaller in cross section than ducts 340. This helps create an increased velocity in ducts 360. This increased velocity increases the negative pressure in duct 350 and, as a result, increases the flow through duct 350.

Although FIG. 3 is an example of the fluid dynamics involved, it is noted that reducing the duct cross section (from duct 340 to duct 360) is not required for embodiments of the disclosure to produce the flow described with reference to FIG. 2.

Figure 4:
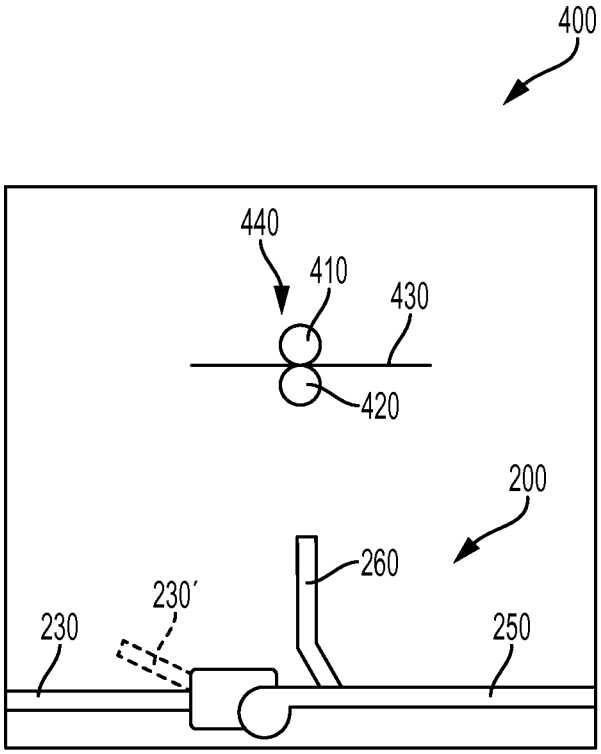
FIG. 4 is a schematic view of an image forming apparatus in accordance with embodiments of the disclosure.

FIG. 4 shows an example of an image forming apparatus 400 in accordance with embodiments of the disclosure. Image forming apparatus 400 includes an image forming section 440 that, in this example, includes a pressure roll 420 and a fuser roll 410 that form a nip through which a sheet of media 430 passes. An example of a contamination control apparatus 200 is shown in an internal compartment of image forming apparatus 400. As can be seen in FIG. 4, an alternative or optional first duet 230' may also be used for clean air flow through the optional first duct to the plenum. The second duct 260 is shown with an opening in the image forming apparatus 400 adjacent the image forming section 440 and a heat source (e.g., fuser roll 410) thereof.

Figure 5:
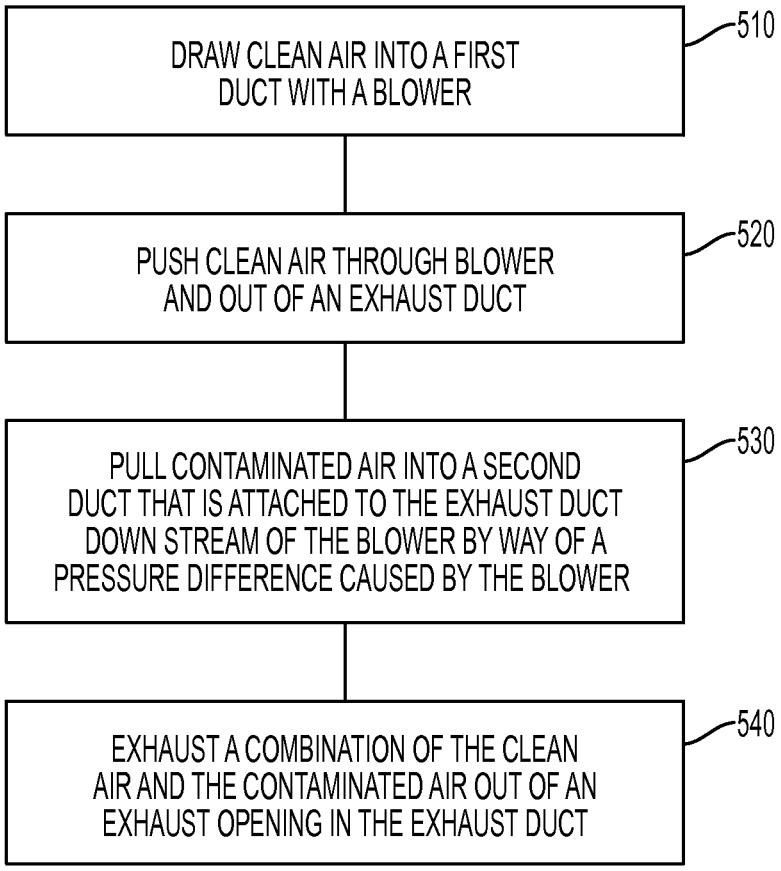
FIG. 5 shows an example of a method in accordance with embodiments of the disclosure.

FIG. 5 shows an example of a method in accordance with embodiments of the disclosure. In FIG. 5, clean air is drawn into a first duct by a blower at 510. Clean air is pushed through the blower and out of an exhaust duct in 520. Contaminated air is pulled into a second duct that is attached to the exhaust duct downstream of the blower by way of a pressure difference cause by the blower at 530. And a combination of the clean air and the contaminated air is exhausted out of an exhaust opening in the exhaust duct in 540.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A contamination control apparatus for controlling contamination in an image forming device, the apparatus comprising:

an air mover located in the image forming device having an air input and an air output, the air mover configured to move non-compressed air from the air input to the air output;

a first duct within the image forming device having a first end and a second end, the first end having an opening positioned to receive non-contaminated air that is not contaminated with the contamination from inside the image forming device, and the second end being fluidly connected to the air input of the air mover such that the air input receives the non-contaminated air from the first duct;

an exhaust duct within the image forming device having a first end and a second end, the first end being fluidly connected to the air output of the air mover such that the first end of the exhaust duct receives only the non-compressed non-contaminated air from the air output, the exhaust duct being split into a plurality of non-contaminated air exhaust ducts, each of the plurality of non-contaminated air exhaust ducts having a first portion with a first cross section and a second portion downstream of the first portion and having a second cross section, the second cross section being smaller than the first cross section to increase the velocity of the non-contaminated air within; and a second duct within the image forming device having a first end and a second end, the first end being positioned such that contaminated air from a contamination producing element of the image forming device is drawn into the first end of the second duct, and the second end of the second duct being fluidly connected to each of the plurality of non-contaminated air exhaust ducts at a position downstream of the air output of the air mover and upstream of the second end of the exhaust duct such that each of the plurality of non-contaminated air exhaust ducts outputs only the non-contaminated air from the air output to the connection with the second duct, the second portion of each non-contaminated air exhaust ducts having the smallest cross section of the respective non-contaminate air exhaust duct, the second cross section at the smallest cross section expanding only at the fluid connection with the second end of the second duct and at the fluid connection with another one of the plurality of non-contaminated air exhaust ducts, wherein the non-compressed non-contaminated air from the plurality of non-contaminated air exhaust ducts and the contaminated air are mixed together in the exhaust duct downstream of the air output of the air mover and upstream of the second end of the exhaust duct to form a mixed air, and the mixed air is exhausted from the second end of the exhaust duct.

2. The apparatus of claim 1, further comprising a plenum, the plenum being fluidly connected to the second end of the first duct and fluidly connected to the air input of the air mover such that the plenum is downstream of the first duct and upstream of the air mover.

3. The apparatus of claim 2, wherein opening of the first end of the second duct is located adjacent to a heat source of the image forming device.

4. The apparatus of claim 3, wherein a flow of the non-contaminated air in the exhaust duct creates a negative pressure in the second duct, the negative pressure causing the contaminated air to flow through the second duct.

5. The apparatus of claim 4, wherein the non-contaminated air that flows through the first duct is the only air that flows through the air mover.

6. The apparatus of claim 5, wherein all of the non-contaminated air that flows through the air mover and all of the contaminated air that flows through the second duct exits through the second end of the exhaust duct.

7. The apparatus of claim 1, wherein a flow of the non-contaminated air in the exhaust duct creates a negative pressure in the second duct, the negative pressure causing the contaminated air to flow through the second duct.

8. The apparatus of claim 7, wherein the non-contaminated air that flows through the first duct is the only air that flows through the air mover.

9. The apparatus of claim 8, wherein all of the non-contaminated air that flows through the air mover and all of the contaminated air that flows through the second duct exits through the second end of the exhaust duct.

10. An image forming device, comprising:

an image forming section that produces contamination;

a contamination control apparatus for controlling the contamination, the contamination control apparatus having an air mover located in the image forming device, the air mover having an air input and an air output, the air mover configured to move non-compressed air from the air input to the air output;

a first duct within the image forming device having a first end and a second end, the first end having an opening positioned to receive non-contaminated air that is not contaminated with the contamination, and the second end being fluidly connected to the air input of the air mover such that the air input receives the non-contaminated air from the first duct;

an exhaust duct within the image forming device having a first end and a second end, the first end being fluidly connected to the air output of the air mover such that the first end of the exhaust duct receives only the non-compressed non-contaminated air from the air output, the exhaust duct being split into a plurality of non-contaminated air exhaust ducts, each of the plurality of non-contaminated air exhaust ducts having a first portion with a first cross section and a second portion having a second cross section, the second cross section being smaller than the first cross section to increase the velocity of the non-contaminated air within; and a second duct within the image forming device having a first end and a second end, the first end being positioned such that contaminated air from the image forming section of the image forming device is drawn into the first end of the second duct, and the second end of the second duct being fluidly connected to each of the plurality of non-contaminated air exhaust ducts at a position downstream of the air output of the air mover and upstream of the second end of the exhaust duct such that each of the plurality of non-contaminated air exhaust ducts outputting only the non-contaminated air from the air output to the connection with the second duct, the second portion of each non-contaminated air exhaust ducts having the smallest cross section of the respective non-contaminate air exhaust duct, the second cross section at the smallest cross section expanding only at the fluid connection with the second end of the second duct and at the fluid connection with another one of the plurality of non-contaminated air exhaust ducts, wherein the non-compressed non-contaminated air from the plurality of non-contaminated air exhaust ducts and the contaminated air are mixed together in the exhaust duct downstream of the air output of the air mover and upstream of the second end of the exhaust duct to form a mixed air, and the mixed air is exhausted from the second end of the exhaust duct.

11. The device of claim 10, further comprising a plenum, the plenum being fluidly connected to the second end of the first duct and fluidly connected to the air input of the air mover such that the plenum is downstream of the first duct and upstream of the air mover.

12. The device of claim 11, wherein opening of the first end of the second duct is located adjacent to a heat source of the image forming device.

13. The device of claim 12, wherein a flow of the non-contaminated air in the exhaust duct creates a negative pressure in the second duct, the negative pressure causing the contaminated air to flow through the second duct.

14. The device of claim 13, wherein the non-contaminated air that flows through the first duct is the only air that flows through the air mover.

15. The device of claim 14, wherein all of the non-contaminated air that flows through the air mover and all of the contaminated air that flows through the second duct exits through the second end of the exhaust duct.

16. The device of claim 10, wherein a flow of the non-contaminated air in the exhaust duct creates a negative pressure in the second duct, the negative pressure causing the contaminated air to flow through the second duct.

17. The device of claim 16, wherein the non-contaminated air that flows through the first duct is the only air that flows through the air mover.

18. The device of claim 17, wherein all of the non-contaminated air that flows through the air mover and all of the contaminated air that flows through the second duct exits through the second end of the exhaust duct.

19. A method of controlling contamination in an image forming device, the method comprising:

moving with an air mover within the image forming device non-contaminated air that is not contaminated with the contamination from inside the image forming device, the air mover configured to move non-compressed air from an air input to an air output of the air mover;

moving the non-contaminated air through a first duct within the image forming device having a first end and a second end, the first end having an opening positioned to receive the non-contaminated air, and the second end being fluidly connected to the air input of the air mover such that the air input receives the non-contaminated air from the first duct;

moving the non-compressed non-contaminated air through an exhaust within the image forming device duct having a first end and a second end, the first end being fluidly connected to the air output of the air mover such that the first end of the exhaust duct receives only the non-compressed non-contaminated air from the air output, the exhaust duct being split into a plurality of non-contaminated air exhaust ducts, each of the plurality of non-contaminated air exhaust ducts having a first portion with a first cross section and a second portion having a second cross section, the second cross section being smaller than the first cross section to increase the velocity of the non-contaminated air within, wherein moving the non-compressed non-contaminated air through the exhaust duct includes moving the non-compressed non-contaminated air through the plurality of non-contaminated air exhaust ducts; and moving contaminated air from a contamination producing element of the image forming device though a second duct within the image forming device having a first end and a second end, the first end being positioned such that the contaminated air is drawn into the first end of the second duct, and the second end of the second duct being fluidly connected to each of the plurality of non-contaminated air exhaust ducts at a position downstream of the air output of the air mover and upstream of the second end of the exhaust duct such that each of the plurality of non-contaminated air exhaust ducts outputting only the non-contaminated air from the air output to the connection with the second duct, the second portion of each non-contaminated air exhaust ducts having the smallest cross section of the respective non-contaminate air exhaust duct, the second cross section at the smallest cross section expanding only at the fluid connection with the second end of the second duct and at the fluid connection with another one of the plurality of non-contaminated air exhaust ducts, wherein the non-compressed non-contaminated air from the plurality of non-contaminated air exhaust ducts and the contaminated air are mixed together in the exhaust duct downstream of the air output of the air mover and upstream of the second end of the exhaust duct to form a mixed air, the mixed air is exhausted from the second end of the exhaust duct, and a flow of the non-compressed non-contaminated air in the exhaust duct creates a negative pressure in the second duct, the negative pressure causing the contaminated air to flow through the second duct.

* * * * *